United States Patent [19]

Kostopolos

[11] Patent Number: 4,747,291

[45] Date of Patent: May 31, 1988

[54] HYDRAULIC FORCE APPLYING DEVICE IN A ROLLING MILL STAND

[75] Inventor: Peter Kostopolos, Pittsburgh, Pa.

[73] Assignee: United Engineering Rolling Mills, Inc., Pittsburgh, Pa.

[21] Appl. No.: 867,081

[22] Filed: May 27, 1986

[51] Int. Cl.[4] ..... B21B 31/08

[52] U.S. Cl. ..... 72/238; 72/239; 72/245

[58] Field of Search ..... 72/199, 240, 243, 245, 72/238, 239; 92/58.1, 59, 128

[56] References Cited

U.S. PATENT DOCUMENTS

| | | | |
|---|---|---|---|
| 2,040,755 | 5/1936 | Meyer | 72/245 |
| 2,985,042 | 5/1961 | Talbot | 72/245 |
| 3,242,711 | 3/1966 | Fox | 72/245 |
| 3,427,839 | 2/1969 | Neumann | 72/245 |
| 3,596,490 | 8/1971 | Willeke | 72/240 |
| 3,906,767 | 9/1975 | Tanaka et al. | 72/21 |
| 3,948,072 | 4/1976 | Aramaki | 72/245 |
| 4,041,752 | 8/1977 | Dolenc et al. | 72/245 |
| 4,083,213 | 4/1978 | Vydrin et al. | 72/6 |
| 4,095,448 | 6/1978 | Gipperich | 72/245 |
| 4,173,881 | 11/1979 | Rose | 72/245 |
| 4,194,383 | 3/1980 | Huzyak | 72/245 |
| 4,468,944 | 9/1984 | Foss | 72/35 |
| 4,481,800 | 11/1984 | Ruhl | 72/10 |

*Primary Examiner*—Lowell A. Larson
*Assistant Examiner*—Donald R. Studebaker
*Attorney, Agent, or Firm*—Suzanne Kikel

[57] ABSTRACT

A mounting and handling arrangement for a hydraulic force applying system used to adjust and maintain a passline in a rolling mill stand comprises a hydraulic device having a manifold member extending through the top of a housing and connected to a piston cylinder assembly. Manifold member carries a position transducer along with its electrical components and hydraulic line connections communicating with internal passages for delivering hydraulic fluid to the piston cylinder assembly. Cradle assembly comprising a plate and brace members receive and support the hydraulic force assembly for its insertion and removal from the roll stand.

17 Claims, 3 Drawing Sheets

HYDRAULIC FORCE APPLYING DEVICE IN A ROLLING MILL STAND

BACKGROUND OF THE INVENTION

Field of the Invention

The present invention relates to a stand for a rolling mill where the passline is adjusted through a hydraulic force applying system having a hydraulic device in each of the housings of the stand. More particularly, it relates to a mounting arrangement thereof providing internal hydraulic passages in a manifold connected to a piston cylinder assembly, and which manifold extends through the housing and carries a transducer assembly for detecting the displacement of the piston cylinder assembly components, including a cradle assembly for easy handling of the hydraulic device and its transducer assembly in the stand.

A rolling mill roll stand normally consists of one or more devices for adjusting the roll gap between which material passes for its reduction. Such devices may be screw-down mechanisms and/or hydraulic force assemblies for setting the gap and applying pressure to at least one of the rolls to continually readjust the gap upon a variance in the gauge of the material passing between the work rolls which material causes a variance in the dimension of the roll gap.

Recently, hydraulic force applying systems have entirely replaced the screw-down mechanisms for gap and gauge control, i.e., for setting the gap and thereafter readjusting the gap for constant gauge control for the material, such as a steel strip.

In the stands employing a screw-down mechanism, the threaded spindle extends down through a bore in a housing, as exemplified in U.S. Pat. No. 4,083,213. In the past it was common to retrofit mills employing a hydraulic force applying system where several elongated bolts extending through the top of the housing affix the cylinder assembly to the housing in an upper area of a window of the housing. The hydraulic connections to the piston cylinder assembly are usually brought through the housing window, and being that these lines are long and flexible, they easily move around becoming entangled with the other hydraulic and electrical lines for the several mill stand components, thereby creating a hazardous and unsafe condition in the mill. In addition, these hydraulic lines to the force applying system reach into an awkward location in the housing interferring to an extent such that an optimal operation of the mill stand is substantially reduced.

In a hydraulic force applying system similar to that described in the immediately preceding paragraph, a position detecting means may be used to detect the displacement of either the piston or the cylinder, thus representing a change in the dimension of the roll gap. Oftentimes, this position detecting means is arranged such that it is exposed to the harsh environment which a rolling mill inherently engenders, thereby quickening the service life of the detecting means.

These present hydraulic force applying systems for controlling the roll gap consists of several short-lived items which require the system to be replaced quite frequently, for example, on an average of every three months. When considering that the rolling mill line consists of several stands, each which may carry a hydraulic gap system, it is readily appreciated that replacement and/or maintenance of the hydraulic system for each stand involves considerable downtime in that their removal involves an extensive, awkward operation due to the mounting arrangement for the hydraulic device and its hydraulic connections in the housing.

In the above-mentioned mounting designs where elongated bolts extending in the housing are used to mount the cylinder in the housing, the hydraulic system, if not supported, free falls down in the housing window, which condition can damage both the hydraulic device and other mill components as well as present a dangerous situation for the workmen. A mill operator must set the hydraulic device onto an auxiliary apparatus, such as a roll changing rig, or an overhead crane, or onto the lower back-up roll chock for removal therewith.

SUMMARY OF THE INVENTION

It is, therefore, an object of the present invention to provide a more convenient manner in which to mount a hydraulic device of a force applying system in a housing of a mill stand, thereby providing a safer working condition and environment for the workmen in a rolling mill line.

It is a further object of the present invention to protect the position detecting assembly associated with the hydraulic force applying system from exposure to the harsh surrounding environment in the rolling mill line. An elongated manifold member mounted in the top of a housing carries both the hydraulic connections and passages for one of the hydraulic devices in a hydraulic force applying system and a position transducer assembly for detecting the relative displacement occurring between the piston and cylinder, which cylinder is mounted to the manifold member.

A still further object of the invention is to provide in an existing mill stand whose housing had previously contained a screw-down mechanism, a hydraulic force applying piston cylinder assembly which is easily mounted into the existing bore in the housing. An annular ring provided in the cavity previously occupied by the screw nut of the screw-down mechanism seats the cylinder of the piston cylinder assembly in the top portion of the window in the housing. The cylinder is bolted to the manifold member, which, in turn, is locked onto the top of the housing. This same arrangement can also be provided for new mills.

Another object of the present invention is to provide a mounting arrangement for the hydraulic piston cylinder assembly of the force applying system which is easily and safely inserted and removed from the stand. Extending from the top of the manifold member is a yoke, which is engageable by an overhead crane, which crane can with relative ease raise and lower the hydraulic device in the housing.

Yet a further object of the present invention is to provide a cradle assembly mountable on a chock of a roll, preferably a lower back-up roll, in supporting relationship with the manifold member and the piston cylinder assembly as a unit in its replacement in the roll stand.

These objects, as well as other novel features and advantages of the present invention, will be better appreciated and understood when the following description is read along with the accompanying drawings of which:

DETAILED DESCRIPTION OF A PREFERRED EMBODIMENT

Figure 1A:
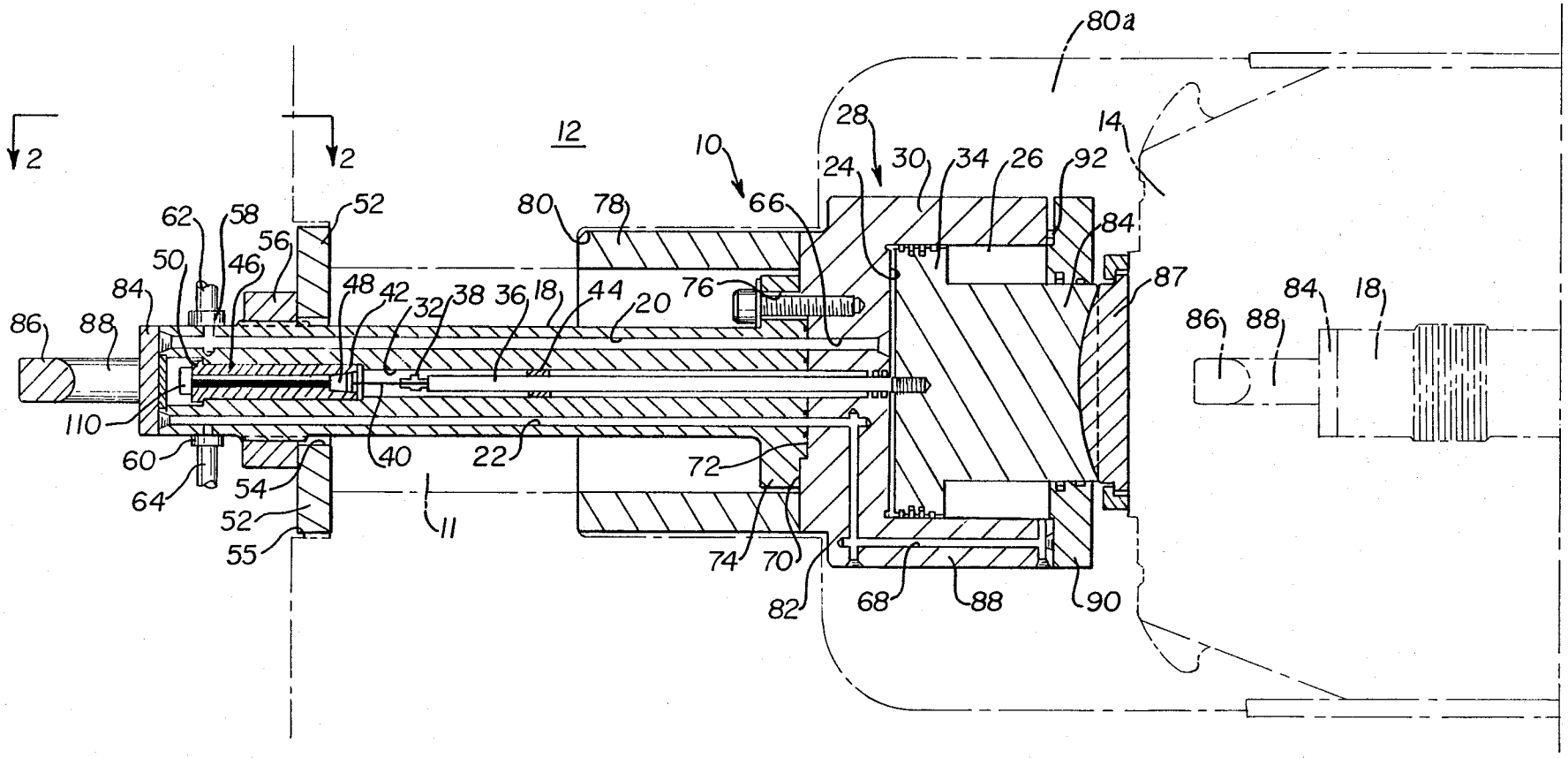
FIG. 1A is a sectional, elevational view showing a rolling mill stand with a mounting for a device for adjustment of a roll gap according to the present invention.
Figure 1B:
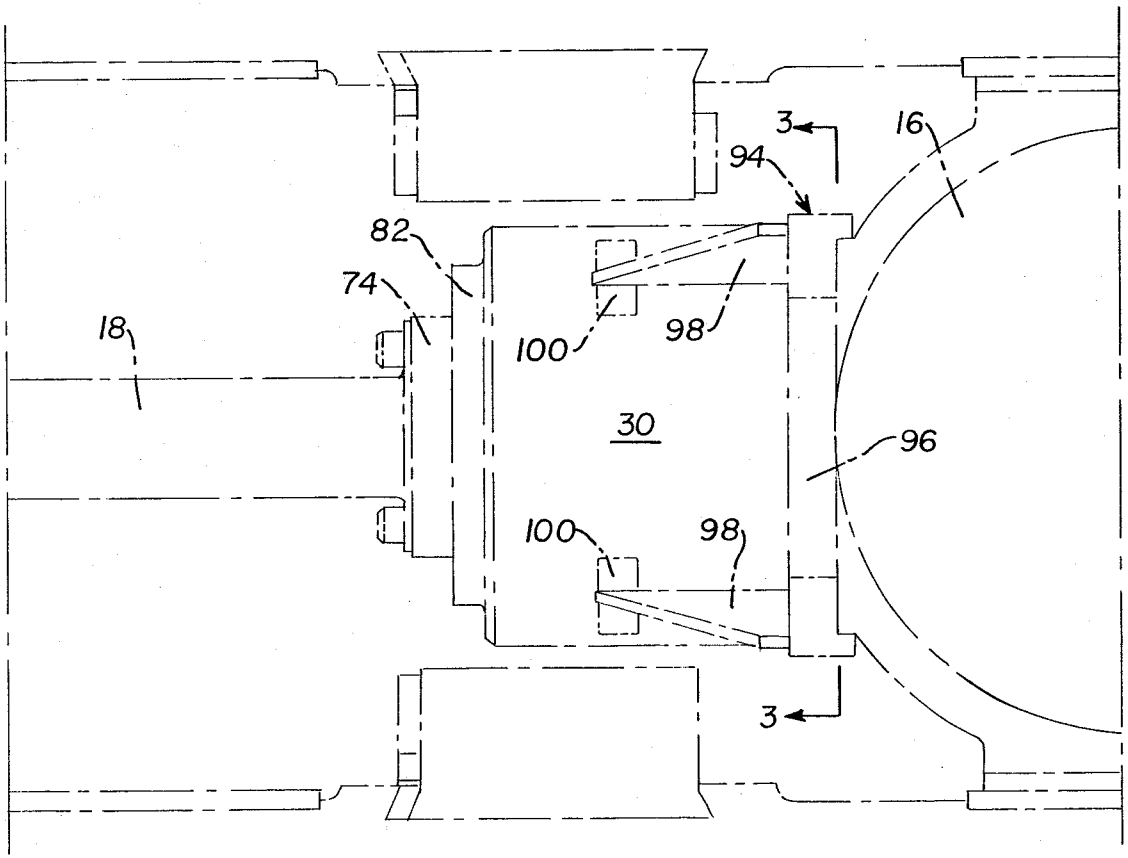
FIG. 1B is a phantom view showing a lower portion of FIG. 1A, whereby the device for roll adjustment is lowered and supported by a roll in accordance with a further teaching of the present invention.

Referring first to FIGS. 1A and 1B, illustrated therein is an arrangement for carrying a hydraulic device 10 for automatic adjustment of a roll gap in a rolling mill stand, which stand consists of two spaced-apart housings supporting rolls in their bearing chocks used for the reduction of material, such as a steel strip, and one of which housing 12 is shown in phantom in FIGS. 1A and 1B, and which hydraulic devices 10 are symmetrically arranged in the two housings on both sides of the stand.

Generally, the present invention finds particular application in conjunction with a hydraulic gauge control system for a four high mill, and which system includes a hydraulic piston cylinder assembly through which force is applied to the ends of a chock of an upper back-up roll, an upper portion of such chock being shown at 14 in outline form. Furthermore, the stand represented in FIGS. 1A and 1B generally consists of, in addition to an upper back-up roll, a lower back-up roll 16 shown in outline form in FIG. 1B, and two work rolls (not shown) defining a passline of the mill and the space between their opposed working surfaces defining the roll gap for the stand.

An illustration of the lower portion of FIG. 1A appears in FIG. 1B. In a phantom or outline positioning of hydraulic device 10 in the lower portion of FIG. 1A and in FIG. 1B, the upper back-up roll and the work rolls have been removed in order for the device 10 to be supported onto the chock of lower back-up roll 16. Removal of the back-up rolls and work rolls is normally done through a window in a housing by a roll changing rig.

The automatic roll gap adjustment device 10 as noted is located in a vertically arranged opening 11 in each of the two housings 12 of stand, and each comprises in the top of elongated circular manifold member 18 extending out of and through the top of housing 12 as shown in the top of FIG. 1A. Manifold member 18 is one of the novel aspects of the invention in that it contains passages 20 and 22 for delivering and carrying hydraulic fluid under pressure to and from the cylinder and piston sides 24 and 26, respectively, of the hydraulic piston cylinder assembly 28. These passages 20 and 22 are formed by drilling holes in manifold member 18 and in cylinder 30, i.e., cylinder 30 has coaxial openings each communicating with the drilled holes in manifold member 18, more about which will be discussed shortly.

Located in a central larger drilled hole 32 in manifold member 18 and into a coaxial opening in cylinder 30 communicating with the central hole 32 of manifold member 18 is a transducer assembly for detecting the positioning or displacement of piston 34 in cylinder 30 of a hydraulic piston cylinder assembly 28. The transducer assembly comprises a connecting rod 36 which is an elongated sheath extending partly into central hole 32 and partly into the central opening of cylinder 30, and which sheath has threads at its lower end which screw into the top of piston 34. Above these threads in the sheath of the connecting rod are two sealing rings, which are not numbered in order to avoid crowding in this area.

Mounted at the upper end of connecting rod 36 with reference to FIG. 1A is a hex stud element 38 connected to a linear gauge 40 which is a wire-like element, and which, in turn, extends into a transducer unit 42 of the transducer assembly in surrounding relationship thereof.

The transducer assembly operates on a magnetic principle for detecting displacement of the components of the piston cylinder assembly and may be bought under the trade name Magnascale manufactured by the Sony Corporation of Japan. Mounted in the central hole 32 approximately midway between the length of manifold member 18 is an annular permanent magnet 44 in surrounding relation with the connecting rod 36. Immediately above connecting rod 36 is transducer unit 42 arranged in the upper portion of the central hole 32 in manifold member 18 and consists of a tubular member 46 carrying a transmitter 48 through which linear gauge 40 runs and travels upon reciprocation of piston cylinder assembly 28.

The length of connecting rod 36 is such that when the piston 34 is in its lowest position in the cylinder 30 in FIG. 1A, it always extends beyond permanent magnet 44. As connecting rod 36 moves up and down, a magnetic field is generated and the value of the magnetic flux or gauss is transmitted through linear gauge 40 and received by transmitter 48 which, in turn, sends a signal to a control for the hydraulic force assembly to deliver pressurized fluid to the appropriate side of piston cylinder assembly 28, to thereby maintain the roll gap of the mill at a predetermined dimension. The principles and operation of a magnetic position transducer also known as a linear variable differential transducer are well-known in the industry, and therefore, no further discussion thereof is necessary.

Transmitter unit 42 is carried by tubular member 46 which is a low carbon steel, and which can be purchased in cartridge form, i.e., the tubular member 46 combined with transmitter 48, thereby permitting easy insertion and removal of the transmitter unit 42 from central hole 32 through the top of manifold member 18. Tubular member 46 has a flanged top portion 50 near the top of manifold member 18 extending into a greater diametral area of central hole 32. Flanged portion 50 abuts and is supported by machined surfaces in greater diametral area near the juncture where the lesser diametral opening meets the greater diametral area of central hole 32.

Still referring to FIG. 1A, the top of housing 12 has an annular member 52 with a central bore 54 through which manifold member 18 extends for its mounting in housing 12. Annular member 52 is received and supported by a cut-out annular area 55 in housing 12 with machined surfaces corresponding to those of annular member 52. Abutting annular member 52 is a locking nut 56 which is screwed onto a threaded portion of manifold member 18 for suspending manifold member 18 in the drilled hole 32 in the top of housing 12.

Above locking nut 56 and the threaded portion of manifold member 18 is a flange 58, 60 and a hydraulic pipe connection 62, 64 which are easily affixed and removed from manifold member 18 through means, not shown, to the right of FIG. 1A. Pipe connection 12 communicates with passageway 20 to deliver approximately 3000 psi to the cylinder side 24 for closing the roll gap and maintaining the gap against the rolling load of the mill. To the left of FIG. 1A, pipe connection 64 communicates with passageway 22 to deliver approximately 150 psi in the piston side 26 of the piston cylinder assembly 28 to open the gap.

As shown in FIG. 1A, passageway 20 is generally a straight drilled hole in manifold member 18 which is coaxial to hole 66 in cylinder 30 thereby communicating with the cylinder side 24, and passageway 22 consists of several drilled holes taking the configuration shown in FIG. 1A in manifold member 18 and a coaxial drilled hole 68 in cylinder 30 shown to the left in FIG. 1A. A gasket member is mounted around each of passageways 20, 22 at the juncture of manifold member 18 and cylinder 30. The top surface of cylinder 30 is machined with an outer annular peripheral portion 70 and an indented inner circular portion 72 which portions 70, 72, receive corresponding machined portions of the base 74 of manifold member 18.

Annular base 74 of manifold member 18 has a plurality of drilled holes 76 (one of which is shown in hard line in FIG. 1A and two of which are shown in FIG. 1B) for receiving a bolt for mounting of cylinder 30 to manifold member 18.

In order to seat cylinder 30 with manifold member 18 in housing 12 there is provided an annular ring 78 which is machined to fit into cavity 80 in housing 12, which cavity 80 may have previously received a nut of a screw in a screw-down mechanism of an existing mill.

When manifold member 18 and cylinder 30 are mounted in housing 12 in a manner which will be explained shortly, a part of outer top peripheral portion 70 of cylinder 30 engages an undersurface of annular ring 78. Cylinder 30 is specially constructed so as to interfit with manifold member 18, annular ring 78, and housing 12 in the upper part of window 80, and has a machined annular cut-out section 82 to abut and fit up into housing 12.

Figure 2:
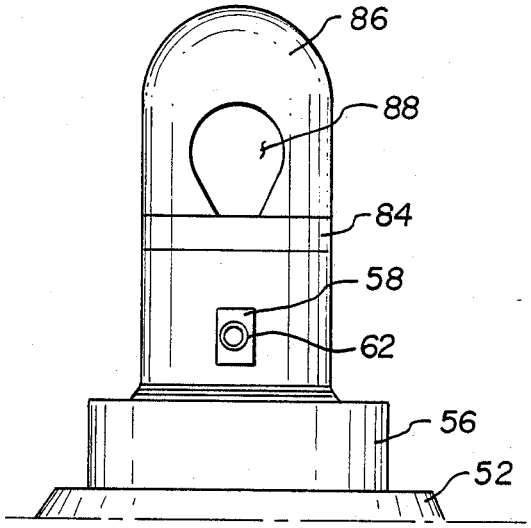
FIG. 2 is an elevational view taken along lines 2—2 of FIG. 1.

With regard to FIGS. 1A and 2, the central drilled hole 32 of manifold member 18 is closed off at the top by an easily removable circular member 84, which is affixed to manifold member 18 through suitable means (not shown), such as bolts. Welded to this circular member 84 is a yoke member 86, which as FIG. 2 illustrates, has an opening 88.

In rolling mill lines, one or more overhead external devices may be used to transport the several components in a mill line. A C-hook of an overhead crane can therefore be inserted in opening 88 of yoke member 86 to support and transport manifold member 18 and cylinder 30 as a unit in their replacement in housing 12.

A hydraulic force applying system having a piston cylinder assembly similar to the present invention is well-known in the industry, as exemplified in U.S. Pat. No. 4,481,800; as are position transducers for detecting the displacement of the piston-cylinder components, as exemplified in U.S. Pat. No. 4,468,944 which two patents are incorporated herein by reference.

An end of piston rod 84 extends out of cylinder 30 and abuts a brass spherical bearing 87 mounted on upper backup roll chock assembly 14, as can be seen in the aforesaid U.S. Pat. No. 4,468,944. Cylinder 30 disclosed herein contains a main receptacle member 88 through which piston 34 travels, and an annular ring 90 affixed to member 88 through suitable means such as welding, encircles piston rod 84.

Sealing means, such as rubber O-rings are used in the various locations to retain the hydraulic fluid in cylinder 30. One such O-ring is shown at 92 at the boundary of member 88 and annular ring 90 of cylinder 30. Also, according to standard practice, several sealing and rider rings are mounted around the outer peripherial surface of piston 34, and in annular ring 90 around piston rod 84.

The lower section of FIGS. 1A and 1B show in a phantom position manifold member 18 with piston cylinder assembly 28 resting on a cradle assembly 94, which assembly 94 in turn, is supported on a chock assembly of the lower back-up roll 16.

Figure 3:
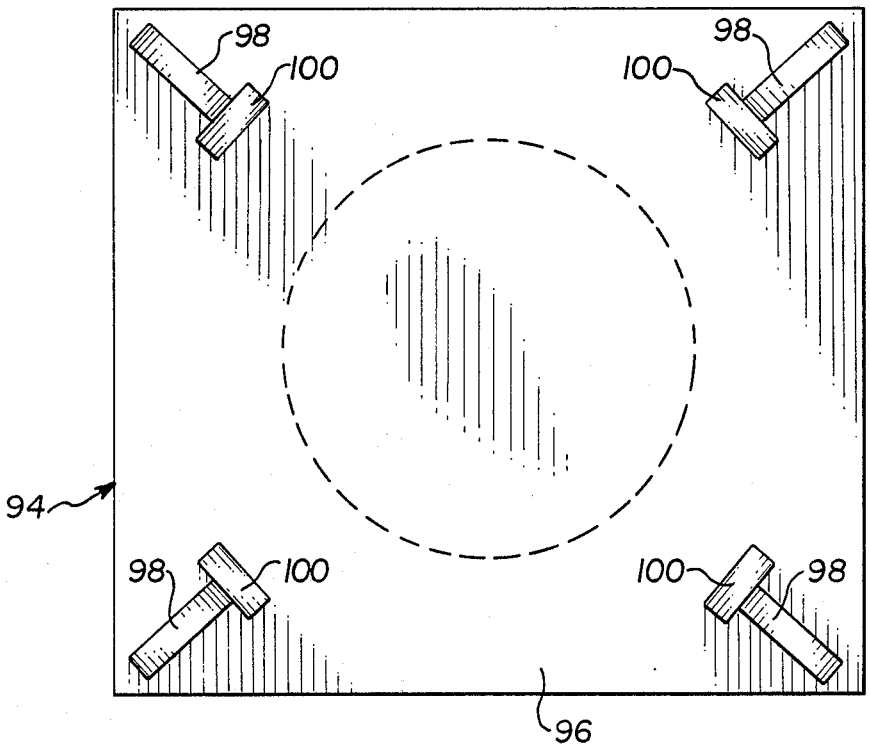
FIG. 3 is a view taken along lines 3—3 of FIG. 1.

Cradle assembly 94 is best seen in FIG. 3, and consists of a generally square member 96 machined on its underside to be seated into the chock assembly of the lower back-up roll 16. Fixedly mounted to member 96 by suitable means such as welding, are a plurality of brace members 98 which, as FIG. 3 shows, a brace member 98 is located at each of the four corners of member 96. Attached to the top of each brace member 98 is a curvilinear pad 100 having a radius corresponding to that of cylinder 30 of piston cylinder assembly 28, which pad first engages cylinder 30 upon its descent in the housing window 80.

Cradle assembly 94 receives and supports piston cylinder assembly 28 with manifold member 18 in a manner to be discussed in the operation of the invention, and with respect to the replacement of hydraulic device 10 in the housing 12 of the roll stand.

Removal of manifold member with piston cylinder assembly 28 as a unit including the transducer assembly is done according to the following procedure with particular reference to FIGS. 1A and 1B. An overhead crane with a C-hook is inserted into opening 88 of yoke member 86 on top of manifold member 18. The work rolls and the upper back-up roll have been taken out through the window 80 of the mill stand. Cradle means 94 is seated onto the chock of lower back-up roll 16 in a position shown in FIG. 1B.

The solid pipeline connections 62, 64 with their flanges 58, 60 are removed from the top of manifold member 18, as is the electrical connection of the transducer assembly. Locking nut 56 is unscrewed from threaded portion of manifold member 18. Annular member 52 is either removed or allowed to remain in its place in housing 12, and manifold member 18 along with piston cylinder assembly 28 and annular ring 78 are eased by the overhead crane down to a position where the several upright brace members 98 receive and guide cylinder 30 onto member 96 of cradle assembly 94 for support as shown in FIG. 1B. Removal of cradle assembly 94 from the stand may be done separately or removed with the lower back-up roll 16.

The above procedure is reversed when manifold member 18 and piston cylinder assembly 28 are inserted into the window 80 of housing 12.

The mounting arrangement of the invention also provides for easy access into manifold member 18 when top member 84 is removed. This is advantageous for maintenance and/or replacement of the transducer unit 42 which can be easily accomplished.

The replacement of the transducer assembly, in particular, tubular member 46 with transmitter 48 and linear gauge 40 in manifold member 18 involves the following operation.

Yoke 86 and member 84 are removed from the top of manifold member 18. A bracket 110 shown in FIG. 1A is affixed through suitable means or can be an integral part of tubular member 46. A workman stands on the housing and brings a strap or some other device through bracket 110, and gently raises the tubular member 46 out through the top of manifold member 18. During this procedure, transmitter 48 travels over linear gauge 40 leaving the gauge 40 supported in hex stud element 38. The hex stud 38 through appropriate means is loosened and the linear gauge wire is removed.

Assemblage of transducer unit 42, that is, tubular member 46 and transmitter 48, into manifold member 18 is done by a procedure reversed to that in the preceding paragraph.

A new linear gauge 40 is inserted into the hex stud element 38, and thus, connecting rod 36, wherein stud element 38 is then tightened. The transducer unit 42 is carefully placed over the linear gauge 40 so that it is centrally located within the transducer unit 42 as shown in FIG. 1A, and lowered into position. Yoke member 86 is bolted to the top of manifold member 18 in preparation for its operation in the stand.

It is to be appreciated that even though a mounting and handling arrangement for a hydraulic device for one of the housings of a mill stand in a hydraulic force applying system has been described and disclosed, that the other housing of the stand is arranged and operates in the same manner as has been described and disclosed herein.

While considerable emphasis has been placed herein on the preferred embodiment disclosed and described, it will be appreciated that many embodiments of the invention can be made and many changes can be made in the preferred embodiment without departing from the scope and spirit of the present invention. In this respect, for example, the manifold member 18 may be an integral part of the housing 13, wherein piston cylinder assembly 28 and transducer holder unit 42 are replaceable. Also, the transducer assembly may be such that it operates on the magnetostictive principle. Such transducer assembly may require little or no variance in the arrangement of components in manifold member 18 and can be purchased from Tempo Sonics of Long Island, N.Y., U.S.A.

In accordance with the patent statutes, I have explained the operation and principles of my invention, and have described and illustrated what I consider to be the best embodiment thereof.

I claim:

1. An arrangement for a hydraulic device of a hydraulic force applying system used to adjust and maintain the gap between work rolls in a rolling mill stand having at least two upright housings each with a window, said work rolls rotatably mounted in said windows having their axis in a common vertical plane relative to said housings with a portion above said each window, said hydraulic device mounted in a bore in said portion of at least one of said housings, said hydraulic device comprising:

an elongated manifold member partially extending out of said housing and partially extending through said bore in said portion of said one housing in said vertical plane opposite said window thereof, and a piston cylinder assembly separable from and fixedly attached to said manifold member as a unit for easy removal and replacemet in said bore of said housing, said assembly being attached to said member at one end of said manifold member beneath said portion of said housing in said vertical plane and having a piston and a cylinder and sides therof for receiving pressurized fluid for reciprocation of said piston for applying said force to said work rolls, said elongated manifold member and said cylinder comprising cooperative passageway means including means in said part of said manifold member extending out of said housing for receiving said pressurized hydraulic fluid at a location outside said housing above said portion in said vertical plane and delivering it through said manifold member into said piston said side and said cylinder side for said reciprocation of said piston cylinder assembly, said elongated manifold member further comprising means for carrying position detecting means for detecting the displacement of said piston upon said reciprocation.

2. An arrangement according to claim 1 further comprising:

external thread means on an outer wall of said manifold member on said part of said manifold member extending out of said housing, and an annular locking ring arranged in surrounding relation with said manifold member and having internal threads engageable with said external thread means on said manifold member, said annular locking ring having surfaces abutting a top surface of said portion of said housing upon engagement of said cooperating thread means thereby supporting said manifold member and said piston cylinder assembly in said housing in a suspended manner.

3. An arrangement according to claim 2 further comprising:

a first annular member arranged in surrounding relation with said manifold member adapted to fit into said bore becoming said top surface of said housing upon which said surface of said annular locking ring abut.

4. An arrangement according to claim 3 further comprising:

a second annular member arranged in surrounding relation with said manifold member near the junction of said manifold member with said piston cylinder assembly in an indented annular area of said bore adapted to seat said manifold member and said piston cylinder assembly in said housing.

5. An arrangement according to claim 1 further comprising:

yoke means mounted on said elongated manifold member and having an opening adapted to be engageable by an external device in a manner said manifold member and said piston cylinder assembly as a unit are easily carried into and out of said housing for replacement therein.

6. An arrangement according to claim 1, wherein said means for carrying said position detecting means in said elongated manifold member has a bore and wherein said cylinder has a coaxial bore, and wherein said position detecting means futher comprises a transduce assembly in said bore of said manifold member and having a connecting rod attached to said piston, and further comprising an enclosure member attachable to said manifold member easily adaptable to be removed therefrom for access into said bore of said manifold member, and to said transducer.

7. An arrangement according to claim 1, wherein said means for receiving said fluid comprises hydraulic connection means communicating with said passageway means and mounted externally on said part of said manifold member extending outside of said housing, and adapted to be detachable from said manifold member.

8. An arrangement according to claim 1 further comprises:

supporting means for said hydraulic device arrangeable in a lower part of said stand and adapted to receive and support said hydraulic device upon its replacement in said housing.

9. An arrangement according to claim 8, wherein said supporting means is a cradle consisting of a supporting member supportable on a roll in said stand and a plurality of upright members engageable with said cylinder for guiding it onto said supporting member.

10. An arrangement for a hydraulic device according to claim 1, further comprising:

means for mounting said elongated manifold member and said piston cylinder assembly in said housing including means connected to said part of said manifold member extending out of said housing for suspending said member and cylinder assembly as a unit in said bore and means in said bore for seating said cylinder assembly therein.

11. A hydraulic device mounted in a mounting element for applying a force to an object remote from said mounting element comprising:

a piston cylinder assembly having a piston and a cylinder and sides thereof for receiving pressurized fluid for reciprocation of said piston in applying said force, an elongated manifold member separable from and fixedly connected to said piston cylinder assembly as a unit for easy removal and replacement in said housing and extending through and partially out of said mounting element in a location remotely away from said piston cylinder assembly, said elongated manifold member and said cylinder having cooperating passageway means including means in said part of said member extending out of said mounting element for receiving pressurized hydraulic fluid in said remote location and delivering it through said manifold member into said piston said and said cylinder side for said reciprocation, said manifold member further comprising means for carrying position detecting means for detecting the displacement of said piston upon said reciprocation.

12. A hydraulic device according to claim 11, wherein said means for receiving fluid comprises hydraulic connection means mounted externally on said manifold member in said remote location communicating with said passageway means, and adapted to be easily connected and disconnected from said manifold member for said replacement of said unit.

13. A hydraulic device according to claim 11, further comprising: means for mounting said elongated manifold member and said piston cylinder assembly as a unit in said mounting element including means for suspending and seating said elongated manifold member and said cylinder as a unit in said mounting element.

14. An arrangement for a hydraulic device of a hydralic force applying system used to adjust and maintain the gap between work rolls in a rolling mill stand having at least two upright housings each with a window, said work rolls rotatably mounted in said windows having their axis in a common vertical plane relative to said housings with a portion above said each window, said hydraulic device mounted in a bore in said portion of at least one of said housings, said hydraulic device comprising:

an elongated manifold member extending through said bore in said portion of said one housing in said vertical plane opposite said window thereof, a piston cylinder assembly fixed attached to one end of said manifold member beneath said portion of said housing in said vertical plane and having a piston and a cylinder and sides thereof for receiving pressurized fluid for reciprocation of said piston for applying said force to said work rolls, said elongated manifold member and said cylinder comprise cooperative passageway means including means for receiving said pressurized hydraulic fluid at a location outside said housing above said portion in said vertical plane and delivering it through said manifold member into said piston side and said cylinder side for said reciprocation of said piston cylinder assembly, external thread means on an outer wall of said manifold member, and an annular locking ring arranged in surrounding relation with said manifold member and having internal threads engagaeable with said external thread means on said manifold member, said annular locking ring having surfaces abutting a top surface of said portion of said housing upon engagement of said cooperating thread means thereby supporting said manifold member in said housing in a suspended manner.

15. An arrangement according to claim 14 further comprising:

a first annular member arranged in surrounding relation with said manifold member adapted to fit into said bore becoming said top surface of said housing upon which said surfaces of said annular locking ring abut.

16. An arrangement according to claim 15 further comprising:

a second annular member arranged in surrounding relation with said manifold member near the junction of said manifold member with said piston cylinder assembly in an indented annular area of said bore adapted to seat said manifold member and said piston cylinder assembly in said housing.

17. An arrangement according to claim 14 further comprising:

supporting means for said hydraulic device arrangeable in a lower part of said stand and adapted to receive and support said hydraulic device upon its replacement in said housing, said supporting means being a cradle consisting of a supporting member supportable on a roll in said stand and a plurality of upright members engageable with said cylinder for guiding it onto said supporting member.

* * * * *

UNITED STATES PATENT AND TRADEMARK OFFICE

CERTIFICATE OF CORRECTION

PATENT NO. : 4,747,291

DATED : May 31, 1988

INVENTOR(S) : PETER KOSTOPOLOS

It is certified that error appears in the above-identified patent and that said Letters Patent is hereby corrected as shown below:

Claim 1, column 8, line 7, "therof" should be --thereof--.

Claim 1, column 8, line 17, "said" (second occurrence) should be deleted.

Claim 6, column 8, line 68, "futher" should be --further--.

Claim 6, column 8, line 69, "transduce" should be --transducer--.

Claim 11, column 9, line 52, "said" (first occurrence) should be --side--.

Claim 14, column 10, line 16, "fixed" should be --fixedly--

Claim 14, column 10, line 35, "engagaeable" should be --engageable--.

Signed and Sealed this

First Day of November, 1988

*Attest:*

DONALD J. QUIGG

*Attesting Officer*

*Commissioner of Patents and Trademarks*